US009291977B1

(12) United States Patent
Kitamura

(10) Patent No.: US 9,291,977 B1
(45) Date of Patent: Mar. 22, 2016

(54) PRINTING MEDIUM CONVEYING UNIT AND IMAGE FORMING APPARATUS

(71) Applicant: Oki Data Corporation, Tokyo (JP)

(72) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/803,934

(22) Filed: Jul. 20, 2015

(30) Foreign Application Priority Data

Oct. 31, 2014 (JP) ..... 2014-223081

(51) Int. Cl.

| | |
|---|---|
| ***G03G 15/00*** | (2006.01) |
| ***B65H 7/20*** | (2006.01) |
| ***B65H 7/02*** | (2006.01) |
| ***B65H 5/26*** | (2006.01) |
| ***B65H 29/58*** | (2006.01) |

(52) U.S. Cl.
CPC ..... *G03G 15/6529* (2013.01); *B65H 5/26* (2013.01); *B65H 7/02* (2013.01); *B65H 7/20* (2013.01); *B65H 29/58* (2013.01)

(58) Field of Classification Search
CPC ..... G03G 15/0131; G03G 15/5058; G03G 15/6564; G03G 2215/00059; G03G 15/0136; G03G 15/161; G03G 15/1615; G03G 15/2028; G03G 15/235; G03G 15/5029; G03G 15/5087; G03G 15/602; G03G 15/607
See application file for complete search history.

(56) References Cited

U.S. PATENT DOCUMENTS

2012/0025457 A1* 2/2012 Inoue ..... B65H 9/002 271/227

FOREIGN PATENT DOCUMENTS

JP 2009-126669 A 6/2009

* cited by examiner

*Primary Examiner* — Roy Y Yi
(74) *Attorney, Agent, or Firm* — Rabin & Berdo, P.C.

(57) ABSTRACT

Provided is a printing medium conveying unit that includes: a first contact section; a second contact section disposed adjacent to the first contact section in a first direction; a printing medium conveying section configured to convey a printing medium in a second direction that is substantially orthogonal to the first direction, in which the printing medium conveying section allows a first edge in the first direction of the printing medium to come into contact with one of the first contact section and the second contact section to displace one of the first contact section and the second contact section in the first direction; and a position detecting section configured to detect a position in the first direction of the first edge, based on an amount of the displacement of one of the first contact section and the second contact section that has come into contact with the first edge.

12 Claims, 7 Drawing Sheets

PRINTING MEDIUM CONVEYING UNIT AND IMAGE FORMING APPARATUS

CROSS REFERENCE TO RELATED APPLICATIONS

This application claims the benefit of Japanese Priority Patent Application JP2014-223081 filed on Oct. 31, 2014, the entire contents of which are incorporated herein by reference.

BACKGROUND

The invention relates to a printing medium conveying unit that conveys a printing medium, and to an image forming apparatus provided with the printing medium conveying unit.

There have been proposed, up to now, a sheet conveying unit that includes a lateral shifting device and an image forming apparatus provided with such a lateral shifting device. The lateral shifting device corrects a shift in position in a lateral direction of a conveyed sheet or a "printing medium". The lateral direction may be orthogonal to a conveying direction of the printing medium. For example, reference is made to Japanese Unexamined Patent Application Publication No. 2009-126669.

SUMMARY

It is desirable that a shift in a lateral direction, orthogonal to a conveying direction, of a printing medium be sufficiently reduced in a printing medium conveying unit and an image forming apparatus.

It is desirable to provide an image forming apparatus that is superior in accuracy of a position at which an image is formed on a printing medium, and a printing medium conveying unit that may be mounted in the image forming apparatus.

A printing medium conveying unit according to an embodiment of the invention includes: a first contact section; a second contact section disposed adjacent to the first contact section in a first direction; a printing medium conveying section configured to convey a printing medium in a second direction that is substantially orthogonal to the first direction, in which the printing medium conveying section allows a first edge in the first direction of the printing medium to come into contact with one of the first contact section and the second contact section to displace one of the first contact section and the second contact section in the first direction; and a position detecting section configured to detect a position in the first direction of the first edge, based on an amount of the displacement of one of the first contact section and the second contact section that has come into contact with the first edge.

An image forming apparatus according to an embodiment of the invention includes: a first contact section; a second contact section disposed adjacent to the first contact section in a first direction; a printing medium conveying section configured to convey a printing medium in a second direction that is substantially orthogonal to the first direction, in which the printing medium conveying section allows a first edge in the first direction of the printing medium to come into contact with one of the first contact section and the second contact section to displace one of the first contact section and the second contact section in the first direction; a position detecting section configured to detect a position in the first direction of the first edge, based on an amount of the displacement of one of the first contact section and the second contact section that has come into contact with the first edge; and an image forming section configured to form an image on the printing medium conveyed by the printing medium conveying section.

In the printing medium conveying unit and the image forming apparatus according to the above-described embodiments of the invention, the position of the edge in the first direction of the conveyed printing medium is detected accurately yet easily.

The printing medium conveying unit according to the above-described embodiment of the disclosure makes it possible to detect the position of the edge in the first direction of the conveyed printing medium accurately yet easily, making it possible to reduce a shift in the first direction of the printing medium sufficiently. Hence, the image forming apparatus provided with the printing medium conveying unit makes it possible to improve an accuracy of a position at which an image is formed on the printing medium.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

DETAILED DESCRIPTION

In the following, some example embodiments of the invention are described in detail with reference to the accompanying drawings. Note that the following description is directed to illustrative examples of the invention and not to be construed as limiting to the invention. Also, factors including, without limitation, arrangement, dimensions, and a dimensional ratio of elements illustrated in each drawing are illustrative only and not to be construed as limiting to the invention.

[Configuration]

Figure 1:
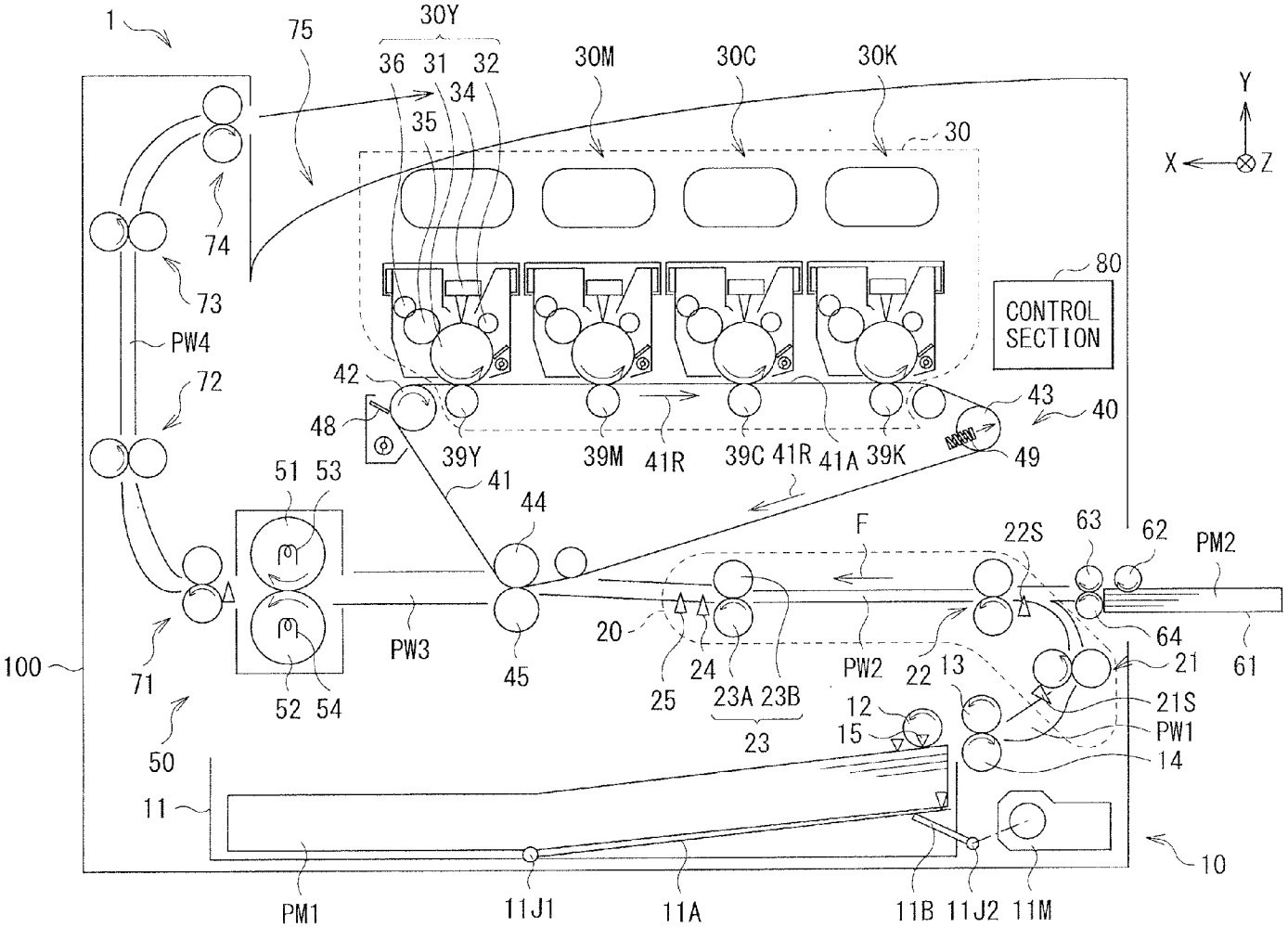
FIG. 1 schematically illustrates an example of an outline configuration of an image forming apparatus according to an embodiment of the invention.
Figure 2:
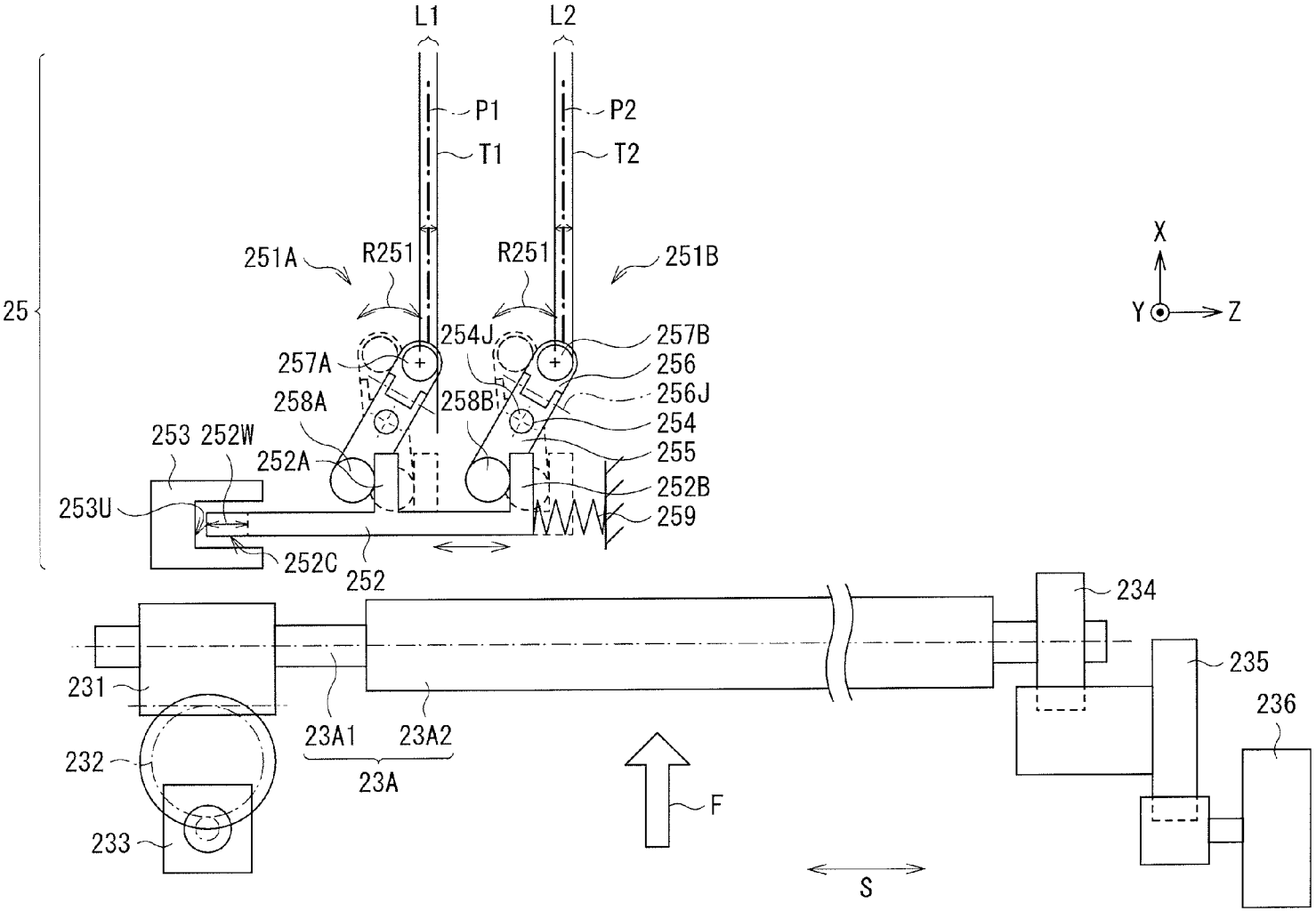
FIG. 2 is a schematic view of an essential part of the image forming apparatus illustrated in FIG. 1 in an enlarged fashion.
Figure 3:
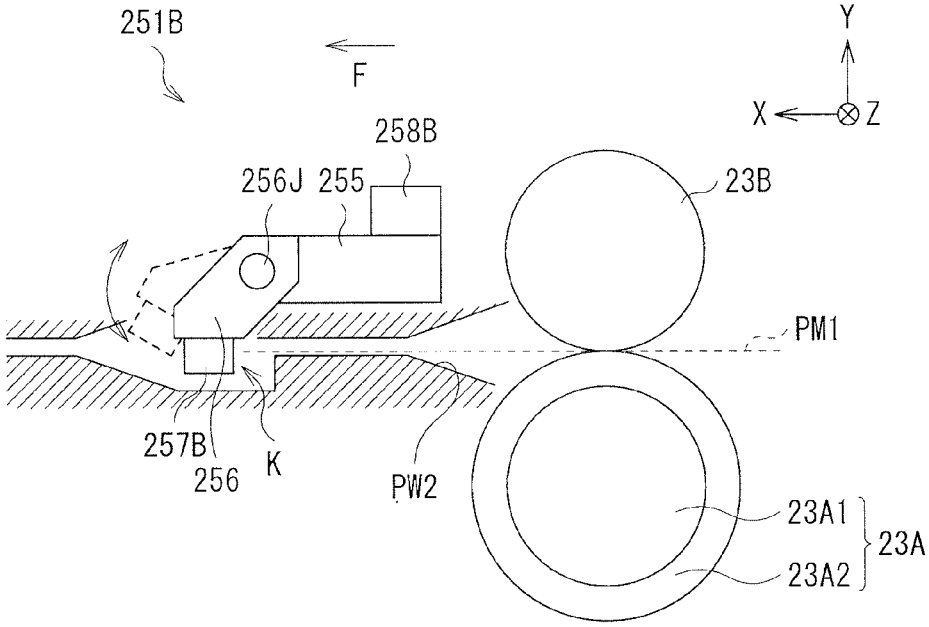
FIG. 3 is another schematic view of the essential part of the image forming apparatus illustrated in FIG. 1 in an enlarged fashion.

FIG. 1 schematically illustrates an example of an overall configuration of an image forming apparatus 1 according to an embodiment of the invention. FIG. 2 is a schematic view of an essential part of the image forming apparatus 1 in an enlarged fashion. FIG. 3 is another schematic view of the essential part of the image forming apparatus 1 in an enlarged fashion. FIGS. 1 and 3 each illustrate a configuration in a plane orthogonal to a plane of FIG. 2. The image forming apparatus 1 may be a printer that forms an image on a printing medium PM1 or PM2 with use of an electrophotographic process. In this example embodiment, the printer may be a color printer that forms a color image as the image. The printing medium PM1 or PM2 (which may also be referred to as a "recording medium" or a "transfer member") may be, for example but not limited to, paper.

The image forming apparatus 1 may include, in order in which the printing medium PM1 or PM2 travels, a medium feeding section (which may be, for example but not limited to, a paper feeding section) 10, a conveying section 20, an image forming section 30, an intermediate transfer section 40, and a fixing section 50. The medium feeding section 10, the conveying section 20, the image forming section 30, the intermediate transfer section 40, and the fixing section 50 may be provided inside a housing 100, except for a part of one or more of such sections. In this disclosure, a direction toward the medium feeding section 10 or a position closer to the medium feeding section 10 as seen from any element is referred to as "upstream", whereas a direction or a position opposite thereto is referred to as "downstream". The image forming apparatus 1 may further include a control section 80 inside the housing 100. The conveying section 20 corresponds to one specific but non-limiting example of a "printing medium conveying unit" in one embodiment of the invention. Also, the image forming section 30 corresponds to one specific but non-limiting example of an "image forming section" in one embodiment of the invention. In this disclosure, a direction in which the printing medium PM1 or PM2 travels in the conveying section 20 is referred to as a "conveying direction F", and a Z axis direction orthogonal to the conveying direction F (i.e., a direction of axis perpendicular to the drawing of FIG. 1 or FIG. 3) is referred to as a "scanning direction S". The conveying direction F corresponds to one specific but non-limiting example of a "second direction" and the scanning direction S corresponds to one specific but non-limiting example of a "first direction" in one embodiment of the invention. Further, in this disclosure, a dimension in the conveying direction F is referred to as a "length", and a dimension in the scanning direction S is referred to as a "width".

[Configuration of Medium Feeding Section 10]

The medium feeding section 10 may include medium feeding trays (which may be, for example but not limited to, paper feeding trays) 11 and 61, pickup rollers 12 and 62, feed rollers 13 and 63, and retard rollers 14 and 64, for example.

The medium feeding trays 11 and 61 may contain the respective printing media PM1 and PM2 stacked therein. For example, the medium feeding tray 11 may be provided attachable to and detachable from the image forming apparatus 1 at a lower part thereof, whereas the medium feeding tray 61 may be provided attachable to and detachable from the image forming apparatus 1 at a side part thereof. The medium feeding tray 11 may include a printing medium placing plate 11A. The printing medium placing plate 11A may be pivotably supported by a shaft 11J1 provided at the bottom of the medium feeding tray 11, and allow the printing medium PM1 to be placed thereon. A lift up lever 11B may be provided on the side of the medium feeding tray 11 from which the printing medium PM1 is taken out. The lift up lever 11B may be pivotably supported by the shaft 11J2. The shaft 11J2 may be rotated by drive force derived from a motor 11M. The motor 11M may be actuated or stopped in response to a signal supplied from, for example but not limited to, the control section 80.

In the medium feeding tray 11, a tip of the lift up lever 11B lifts up the printing medium placing plate 11A by means of the pivot of the lift up lever 11B around the shaft 11J2, causing the printing medium PM1 placed on the printing medium placing plate 11A to be uplifted as well. This configuration brings a top surface of the uppermost printing medium PM1 into contact with the pickup roller 12.

An uplift detecting section 15 may detect that the printing medium placing plate 11A is lifted up to a predetermined height sufficiently and that the top surface of the uppermost printing medium PM1 is brought into contact with the pickup roller 12. The control section 80 may stop driving of the motor 11M, based on a signal supplied from the uplift detecting section 15.

The pickup rollers 12 and 62, the feed rollers 13 and 63, and the retard rollers 14 and 64 may serve as a printing medium taking-out section that feeds the printing medium PM1 stored in the medium feeding tray 11 or the printing medium PM2 stored in the medium feeding tray 61 to the conveying section 20. The pickup rollers 12 and 62 and the feed rollers 13 and 63 may be driven, by means of respective unillustrated motors, to rotate in their respective arrow directions illustrated in FIG. 1. For example, the pickup rollers 12 and 62 and the feed rollers 13 and 63 each may include a one-way clutch mechanism, allowing its rotation drive to be idle in the corresponding arrow direction. The retard rollers 14 and 64 each may generate a rotation torque in the corresponding arrow direction illustrated in FIG. 1, by means of a rotation torque generating section.

The thus-configured medium feeding section 10 feeds the printing medium PM1 or PM2, one by one, to a conveying path PW1 that leads to the conveying section 20.

[Configuration of Conveying Section 20]

The conveying section 20 may be a mechanism that conveys, one by one, the printing medium PM1 or PM2 fed from the paper feeding section 10 to the intermediate transfer section 40 along the conveying path PW2. The conveying section 20 may include pairs of conveying rollers 21 to 23 disposed in order from the upstream to the downstream, for example. The pairs of conveying rollers 21 to 23 may convey the printing medium PM1 or PM2 in the conveying direction F while regulating its skew. The printing medium PM2 fed from the medium feeding tray 61 may join the conveying path PW2 at a region between the pair of conveying rollers 21 and the pair of conveying rollers 22. A printing medium sensor 21S may be provided between the feed roller 13 (and the retard roller 14) and the pair of conveying rollers 21, and a printing medium sensor 22S may be provided between the pair of conveying rollers 21 and the pair of conveying rollers 22. The printing medium sensor 21S may detect a position of the printing medium PM1 or PM2 for adjusting timing of driving of the pair of conveying rollers 21. The printing medium sensor 22S may detect a position of the printing medium PM1 or PM2 for adjusting timing of driving of the pair of conveying rollers 22. Further, a write sensor 24 and an edge sensor 25 may be provided in order at the downstream of the pair of conveying rollers 23. The write sensor 24 may detect a position of the printing medium PM1 or PM2 for adjusting timing of image formation performed by the image forming section 30. The edge sensor 25 detects positions of respective edges T1 and T2 in the scanning direction S of the conveyed printing medium PM1 or PM2.

Referring to FIG. 3 and other drawings, the pair of conveying rollers 23 may have a configuration in which a conveying drive roller 23A and a conveying bias roller 23B located above the conveying drive roller 23A are opposed to each other. The pair of conveying rollers 23 correspond to one specific but non-limiting example of a "printing medium conveying section" in one embodiment of the invention. The printing medium PM1 or PM2 passes between the conveying drive roller 23A and the conveying bias roller 23B. Upon passing, the printing medium PM1 may be so conveyed in the conveying direction F that the edge T1 in the scanning direction S of the printing medium PM1 fits into a lane L1, as illustrated in FIG. 2. The printing medium PM2 may be so conveyed in the conveying direction F that the edge T2 in the scanning direction S of the printing medium PM2 fits into a lane L2, as illustrated in FIG. 2. FIG. 2 illustrates a non-limiting example in which the edge T1 is located at a rightmost part of the lane L1, and the edge T2 is located at a rightmost part of the lane L2. The lane L1 and the lane L2 each may have a width of about 3 mm without limitation, which may be equal to or smaller than a radius of each of pins 257A and 257B to be described later, for example. In the present example embodiment, the width of the printing medium PM1 is wider than the width of the printing medium PM2, and the edge T2 of the printing medium PM2 travels on the inside of the edge T1 of the printing medium PM1 in the scanning direction S. Hence, the lane L2 may be located closer to an end of the conveying drive roller 23A than the lane L1. The lane L1 corresponds to one specific but non-limiting example of a "first lane" and the lane L2 corresponds to one specific but non-limiting example of a "second lane" in one embodiment of the invention.

The conveying drive roller 23A may include a shaft section 23A1 extending in the scanning direction S, and an outer layer section 23A2 that covers a surrounding region of the shaft section 23A1. The shaft section 23A1 may include a first end provided with a rack gear 231 and a second end provided with a drive gear 234. The rack gear 231 may be engaged with a rack pinion gear 232, allowing drive force derived from a roller shift motor 233 to be transmitted to the rack gear 231 through the rack pinion gear 232. The rack gear 231, the rack pinion gear 232, and the roller shift motor 233 correspond to one specific but non-limiting example of a "moving mechanism" in one embodiment of the invention. The moving mechanism may move the conveying drive roller 23A in the scanning direction S. The drive gear 234 may be engaged with a reduction gear 235, allowing drive force derived from a roller drive motor 236 to be transmitted to the drive gear 234 through the reduction gear 235. The conveying drive roller 23A corresponds to one specific but non-limiting example of a "conveying roller" in one embodiment of the invention.

The edge sensor 25 may include a plurality of contact sections 251 (251A and 251B), a slider 252 displaceable in the scanning direction S, and a displacement sensor 253 that detects an amount of displacement 252W of the slider 252, as illustrated in FIG. 2. The contact section 251A includes a portion that comes into contact with the edge T1 of the printing medium PM1, and may be provided corresponding to the lane L1. The contact section 251B includes a portion that comes into contact with the edge T2 of the printing medium PM2, and may be provided corresponding to the lane L2. In this example embodiment, the image forming apparatus 1 includes two contact sections 251, although the image forming apparatus 1 may include three or more contact sections 251. Also, the plurality of sliders 252 and displacement sensors 253 may be provided corresponding to the respective contact sections 251.

The contact section 251A corresponds to one specific but non-limiting example of a "first contact section" and the contact section 251B corresponds to one specific but non-limiting example of a "second contact section" in one embodiment of the invention. The slider 252 and the displacement sensor 253 correspond to one specific but non-limiting example of a "position detecting section" in one embodiment of the invention.

The plurality of contact sections 251 may have the same configuration as one another. In the following, a description is given with reference to the contact section 251B, although the same description may apply to any other contact section in the plurality of contact sections 251 as well. The contact section 251B may include a shaft section 254 directly or indirectly fixed, for example, to the housing 100, and a pivot lever 255 so held by the shaft section 254 as to be pivotable in a direction of an arrow R251 around the shaft section 254. The shaft section 254 may extend in a direction substantially orthogonal to both the scanning direction S and the conveying direction F, i.e., in a Y axis direction. The pivot lever 255 may include a first end attached with a pick lever 256. The pick lever 256 may pivot around a pivot axis 256J that is substantially orthogonal to a pivot axis 254J of the shaft section 254, for example. The pick lever 256 includes a pin 257. The pin 257 may be cylindrical in shape, and may be so erected as to protrude along the pivot axis 254J, for example. The pin 257 may protrude toward the conveying path PW2 as illustrated by way of example in FIG. 3. The pin 257 (hereinafter referred to as a "pin 257B") of the contact section 251B comes in contact, at a side face thereof, with the edge T2 of the printing medium PM2 when the printing medium PM2 narrower in width than the printing medium PM1 is conveyed. This causes, when a position of the edge T2 of the printing medium PM2 is varied, the pin 257B of the contact section 251B to be displaced in the scanning direction S with the variation in the position of the edge T2. When the printing medium PM1 wider in width than the printing medium PM2 is conveyed, an edge K in the conveying direction F of the printing medium PM1 may come into contact with the pin 257B of the contact section 251B. This causes the pin 257B of the contact section 251B to be pushed out further in the conveying direction F by the edge K, which in turn causes the pick lever 256 to pivot around the pivot axis 256J. As a result, the pick lever 256 of the contact section 251B may be retracted from the printing medium PM1. Here, the edge T1 of the printing medium PM1 comes into contact with a side face of the pin 257 (hereinafter referred to as a "pin 257A") of the contact section 251A located on the outer side of the contact section 251B as illustrated in FIG. 2. This causes, when a position of the edge T1 of the printing medium PM1 is varied, the pin 257A of the contact section 251A to be displaced in the scanning direction S with the variation in the position of the edge T1. In this way, the contact section 251A and the contact section 251B may be displaceable in the scanning direction S independently from each other in response to a behavior of the printing medium PM1 or PM2. Incidentally, the pivot lever 255 may further include a second end attached with a pin 258 (258A or 258B). The pin 258 may be cylindrical in shape, and may protrude in an opposite direction to the pin 257, for example.

The slider 252 may be a rod-shaped member that extends in the scanning direction S. The slider 252 may include a first end 252C inserted into a recess 253U of the displacement sensor 253. The slider 252 may include an erected engagement section 252B. The engagement section 252B may be provided at a position corresponding to a position at which the pin 258 (hereinafter referred to as the "pin 258B") of the contact section 251B is provided. The slider 252 may also include an erected engagement section 252A between the first end 252C and the engagement section 252B. The engagement section 252A may be provided at a position corresponding to a position at which the pin 258 (hereinafter referred to as the "pin 258A") of the contact section 251A is provided. The slider 252 may be biased toward the left side of the drawing (i.e., in a direction toward the displacement sensor 253) by an elastic member 259 whose one end may be fixed to the housing 100. The elastic member 259 may be, for example but not limited to, a coiled spring. In this example embodiment, the pin 258A may come into engagement with the engagement section 252A upon the contact of the edge T1 with the pin 257A, and the pin 258B may come into engagement with the engagement section 252B upon the contact of the edge T2 with the pin 257B. In the edge sensor 25, an amount of displacement of the contact section 251A and an amount of displacement of the contact section 251B may be transmitted independently from each other to the displacement sensor 253.

The pivot lever 255 corresponds to one specific but non-limiting example of a "first member" and the pin 257B corresponds to one specific but non-limiting example of a "first protrusion" in one embodiment of the invention. The pick lever 256 corresponds to one specific but non-limiting example of a "second member" and the pin 258B corresponds to one specific but non-limiting example of a "second protrusion" in one embodiment of the invention. The engagement section 252B corresponds to one specific but non-limiting example of a "first engagement section" in one embodiment of the invention.

The displacement sensor 253 detects the amount of displacement of the first end 252C in the slider 252 to detect a position in the scanning direction S of the edge T1 or the edge T2, based on the amount of displacement of the pin 257A in the contact section 251A or the amount of displacement of the pin 257B in the contact section 251B. In other words, the displacement sensor 253 may be operable to detect, by means of the slider 252, a difference in the scanning direction S between the edge T1 of the printing medium PM1 and a reference position P1, or a difference in the scanning direction S between the edge T2 of the printing medium PM2 and a reference position P2. For example, the reference position P1 may be a middle position in the lane L1, and the reference position P2 may be a middle position in the lane L2, although the reference positions P1 and P2 are not limited to the respective middle positions in the lanes L1 and L2. Non-limiting examples of the displacement sensor 253 may include a sensor mounted with a charge-coupled device (CCD) or the like to measure the amount of displacement of the first end 252C by means of image processing, and a sensor that utilizes a linear resistor. The reference position P1 corresponds to one specific but non-limiting example of a "first reference position" and the reference position P2 corresponds to one specific but non-limiting example of a "second reference position" in one embodiment of the invention.

[Configuration of Image Forming Section 30]

The image forming section 30 may include image forming units 30Y, 30M, 30C, and 30K, and primary transfer rollers 39Y, 39M, 39C, and 39K, for example. The primary transfer rollers 39Y, 39M, 39C, and 39K are respectively opposed to the image forming units 30Y, 30M, 30C, and 30K. The image forming units 30Y, 30M, 30C, and 30K each use corresponding one of toners having respective colors, namely, a yellow toner, a magenta toner, a cyan toner, and a black toner, to form a toner image having corresponding one of the colors.

The image forming units 30Y, 30M, 30C, and 30K each may include a photoreceptor drum 31, a charging roller 32, an LED head 34, a developing roller 35, and a feeding roller 36, for example. The charging roller 32, the developing roller 35, and the feeding roller 36 may structure a developing unit, and may operate based on a control performed by the control section 80.

The photoreceptor drum 31 may be a cylindrical member, and extends in the scanning direction S and supports an electrostatic latent image on a surface (a superficial part) of the photoreceptor drum 31. The photoreceptor drum 31 includes a photoreceptor which may be, for example but not limited to, an organic photoreceptor. For example, the photoreceptor drum 31 may include a conductive supporting member, and a photoconductive layer that covers an outer circumference part (a surface) of the conductive supporting member. The conductive supporting member may be, for example but not limited to, a metal pipe made of aluminum. The photoconductive layer may have a configuration in which a charge generating layer and a charge transporting layer are stacked in order, for example. The photoreceptor drum 31 may be rotated at a predetermined circumferential velocity (may be rotated anticlockwise as denoted by an arrow in FIG. 1 in this example embodiment), based on instructions given from the control section 80.

The charging roller 32 may be a member (a charging member) that charges the surface (the superficial part) of the photoreceptor drum 31, and is so disposed as to be in contact with the surface (a circumferential surface) of the photoreceptor drum 31. The charging roller 32 may include a metal shaft, and a semi-conductive rubber layer that covers an outer circumference part (a surface) of the metal shaft, for example. The semi-conductive rubber layer may be, for example but not limited to, a semi-conductive epichlorohydrin rubber layer. In the example embodiment, the charging roller 32 may be rotated clockwise, i.e., rotated in an opposite direction to the photoreceptor drum 31.

The developing roller 35 may be a member that supports the toner, used for development of the electrostatic latent image, on a surface of the developing roller 35, and is so disposed as to be in contact with the surface (the circumferential surface) of the photoreceptor drum 31. The developing roller 35 may include a metal shaft, and a semi-conductive rubber layer that covers an outer circumference part (a surface) of the metal shaft, for example. The semi-conductive rubber layer may be, for example but not limited to, a semi-conductive urethane rubber layer. The developing roller 35 is configured to be rotated at a predetermined circumferential velocity (may be rotated clockwise, i.e., in the opposite direction to the photoreceptor drum 31, in the example embodiment).

The feeding roller 36 may be a member (a feeding member) that feeds the toner to the developing roller 35, and is so disposed as to be in contact with the surface (a circumferential surface) of the developing roller 35. The feeding roller 36 may include a metal shaft, and a rubber layer that covers an outer circumference part (a surface) of the metal shaft, for example. The rubber layer may be, for example but not limited to, a foamed silicone rubber layer. In the example embodiment, the feeding roller 36 may be rotated clockwise, i.e., rotated in the same direction as the developing roller 35.

The LED (Light-Emitting Diode) head 34 may be an exposure unit that exposes the surface of the photoreceptor drum 31 to form the electrostatic latent image on the surface (the superficial part) of the photoreceptor drum 31. The LED head 34 may include a plurality of LED light emitting sections that are arrayed in the scanning direction S for corresponding one of the photoreceptor drums 31. The LED light emitting sections each may include a light source such as light-emitting diodes that emit irradiation light, and a lens array that collects the irradiation light onto the surface of the photoreceptor drum 31, for example.

[Configuration of Intermediate Transfer Section 40]

The intermediate transfer section 40, which may also be called an intermediate transfer belt unit, may include an intermediate transfer belt 41, a drive roller 42, an idle roller 43, a backup roller 44, a cleaner 48, and a biasing member 49. The driver roller 42 may drive the intermediate transfer belt 41. The idle roller 43 may serve as a driven roller. The biasing member 49 may bias the idle roller 43 in a predetermined direction. The drive roller 42, the idle roller 43, and the backup roller 44 each may be a substantially-cylindrical member rotatable around a rotary shaft that extends in the scanning direction S perpendicular to the drawing of FIG. 1. The intermediate transfer section 40 may be a mechanism that conveys the printing medium PM1 or PM2 conveyed from the pair of conveying rollers 23 in the conveying direction F, and transfers the toner images formed by the respective image forming units 30Y, 30M, 30C, and 30K onto a transferred surface 41A of the intermediate transfer belt 41 sequentially in the conveying direction F.

The intermediate transfer belt 41 may be an elastic endless belt made of a resin material such as, but not limited to, a polyimide resin. The intermediate transfer belt 41 may be so provided as to be stretched by and stretched around the drive roller 42, the idle roller 43, and the backup roller 44.

The driver roller 42 may be rotated clockwise in an arrow direction illustrated in FIG. 1 by means of drive force transmitted from an unillustrated belt drive motor to cause the intermediate transfer belt 41 to circulate in a rotating direction 41R. The belt drive motor may be controlled by the control section 80. The driver roller 42 may be disposed upstream of the image forming units 30Y, 30M, 30C, and 30K in the rotating direction 41R of the intermediate transfer belt 41. The idle roller 43 may adjust tensile force applied to the intermediate transfer belt 41, by means of biasing force derived from the biasing member 49. The idle roller 43 may be rotated in the same direction as the rotating direction 41R, and may be disposed downstream of the image forming units 30Y, 30M, 30C, and 30K in the rotating direction 41R. The drive roller 42, the idle roller 43, and the biasing member 49 may structure a driving mechanism that drives the intermediate transfer belt 41. The cleaner 48 may be a member that scrapes the toner attached onto the transferred surface 41A of the intermediate transfer belt 41 to clean the transferred surface 41A.

A secondary transfer roller 45 together with the backup roller 44 may structure a secondary transfer mechanism. The secondary transfer roller 45 and the backup roller 44 may be so disposed as to oppose to each other and interpose the intermediate transfer belt 41 in between. The secondary transfer roller 45 may include a core made of a metal, and an elastic layer so formed as to be wound around an outer circumferential face of the core, for example. The elastic layer may be, for example but not limited to, a foamed rubber layer. The secondary transfer roller 45 may be biased toward the backup roller 44 by an unillustrated biasing member whose one end may be fixed to the housing 100 of the image forming apparatus 1. The biasing member may be, for example but not limited to, a coiled spring. Hence, the secondary transfer roller 45 may be pressed against the backup roller 44 via the intermediate transfer belt 41.

When the backup roller 44 and the secondary transfer roller 45 perform transfer or "secondary transfer" of the toner images, formed on the transferred surface 41A, onto the printing medium PM1 or PM2 fed from the pair of conveying rollers 23, a direct-current voltage may be applied to the secondary transfer roller 45 to generate a potential difference between the secondary transfer roller 45 and the backup roller 44.

[Configuration of Fixing Section 50]

The fixing section 50 may be a member that applies heat and pressure to the toner images transferred onto the printing medium PM1 or PM2 that has traveled along a conveying path PW3 from the backup roller 44 and the secondary transfer roller 45, to fix the toner images onto the printing medium PM1 or PM2. The fixing section 50 may include an upper roller 51 and a lower roller 52 as illustrated in FIG. 1.

The upper roller 51 and the lower roller 52 may have therein their respective heat sources 53 and 54 each may be a heater such as, but not limited to, a halogen lamp. The upper roller 51 and the lower roller 52 may serve as heating rollers that apply the heat to the toner images transferred on the printing medium PM1 or PM2. The upper roller 51 may be driven and rotated by an unillustrated motor controlled by the control section 80, for example. The heat sources 53 and 54 each may receive a supply of a bias voltage to control respective surface temperatures of the upper roller 51 and the lower roller 52. The bias voltage may be controlled by the control section 80.

The lower roller 52 may be so disposed to oppose the upper roller 51 as to form a pressurized part between the upper roller 51 and the lower roller 52, and serve as a pressurizing roller that applies the pressure to the toner images transferred on the printing medium PM1 or PM2. The lower roller 52 may have a surface layer made of an elastic material.

The printing medium PM1 or PM2 sent from the fixing section 50 may be caused to travel along a conveying path PW4 by pairs of conveying rollers 71 to 74. The printing medium PM1 or PM2 having travelled along the conveying path PW4 may be discharged to the outside of the housing 100 to be placed on a stacker 75.

[Action and Effect]

[A. Basic Operation]

The image forming apparatus 1 may transfer the toner images onto the printing medium PM1 or PM2 in a following example manner.

When the activated image forming apparatus 1 receives, from an external device, data on an image to be printed, the control section 80 may initiate a printing operation of the data on the image to be printed.

More specifically, the control section 80 may drive the intermediate transfer belt 41 and the photoreceptor drum 31, and initiate a charging operation of the charging roller 32. Also, the control section 80 may send an exposure control signal to each of the LED heads 34. The LED heads 34 each may irradiate, at timing specified by the exposure control signal, the corresponding photoreceptor drum 31 with light that corresponds to a color component of the image to be printed, to form the electrostatic latent image onto the surface of the corresponding photoreceptor drum 31. The developing rollers 35 each may attach a developer onto the electrostatic latent image formed on the corresponding photoreceptor drum 31 to form the toner image, as a developer image, having corresponding one of the colors of yellow (Y), magenta (M), cyan (C), and black (K). The primary transfer rollers 39Y, 39M, 39C, and 39K each receive application of a transfer bias voltage from an unillustrated power supply circuit to sequentially transfer, in a superimposed manner, the toner images formed on the respective photoreceptor drums 31 onto the transferred surface 41A of the intermediate transfer belt 41.

Then, the control section 80 may rotate the pickup rollers 12 and 62 and the feed rollers 13 and 63 to initiate feeding of the printing medium PM1 or PM2. This causes the printing medium PM1 or PM2 to be fed to the conveying section 20 at a predetermined conveying speed. More specifically, first, the printing medium PM1 stored in the medium feeding tray 11 or the printing medium PM2 stored in the medium feeding tray 61 may be taken out of the medium feeding tray 11 or 61, one by one from the top, by the pickup roller 12 or 62 to be fed toward the feed roller 13 or 63, as illustrated in FIG. 1. The printing medium PM1 or PM2 taken out of the medium feeding tray 11 or 61 may be subjected to skew correction by the feed roller 13 or 63 and the retard roller 14 or 64, following which the corrected printing medium PM1 or PM2 may be conveyed to the intermediate transfer section 40 through the conveying section 20.

When the write sensor 24 detects a position of the printing medium PM1 or PM2, the write sensor 24 may send a detection signal to the control section 80, for example. The control section 80 may adjust a conveying speed of the printing medium PM1 or PM2 and a rotating speed of the intermediate transfer belt 41 to bring the printing medium PM1 or PM2 into coincidence, in position, with the toner images transferred on the intermediate transfer belt 41. This causes the toner images on the intermediate transfer belt 41 to be subjected to the secondary transfer in a predetermined region on the printing medium PM1 or PM2, at a secondary transfer position, i.e., at a position at which the backup roller 44 and the secondary transfer roller 45 are opposed to each other. Following the secondary transfer, the fixing section 50 may apply the heat and the pressure to the toner images transferred onto the printing medium PM1 or PM2 to fix the toner images onto the printing medium PM1 or PM2. Then, the printing medium PM1 or PM2, onto which the toner images are fixed, may be discharged to the outside by the pairs of conveying rollers 71 to 74.

[B. Correction of Traveling Position]

A description is given of an operation on correction of a traveling position of the printing medium PM1 or PM2 performed in the image forming apparatus 1 according to the present example embodiment. The correction of the traveling position as used herein refers to an operation in which a shift in position in the scanning direction S of the printing medium PM1 or PM2 conveyed in the conveying direction F is detected and a position of traveling of the printing medium PM1 or PM2 is so modified as to remove the shift in position in the scanning direction S of the printing medium PM1 or PM2.

The correction of the traveling position is performed in the conveying section 20. The correction of the traveling position may be performed by moving the conveying drive roller 23A in the scanning direction S by means of the moving mechanism that may include the rack gear 231, the rack pinion gear 232, and the roller shift motor 233, based on a detection result derived from the edge sensor 25.

Figure 4:
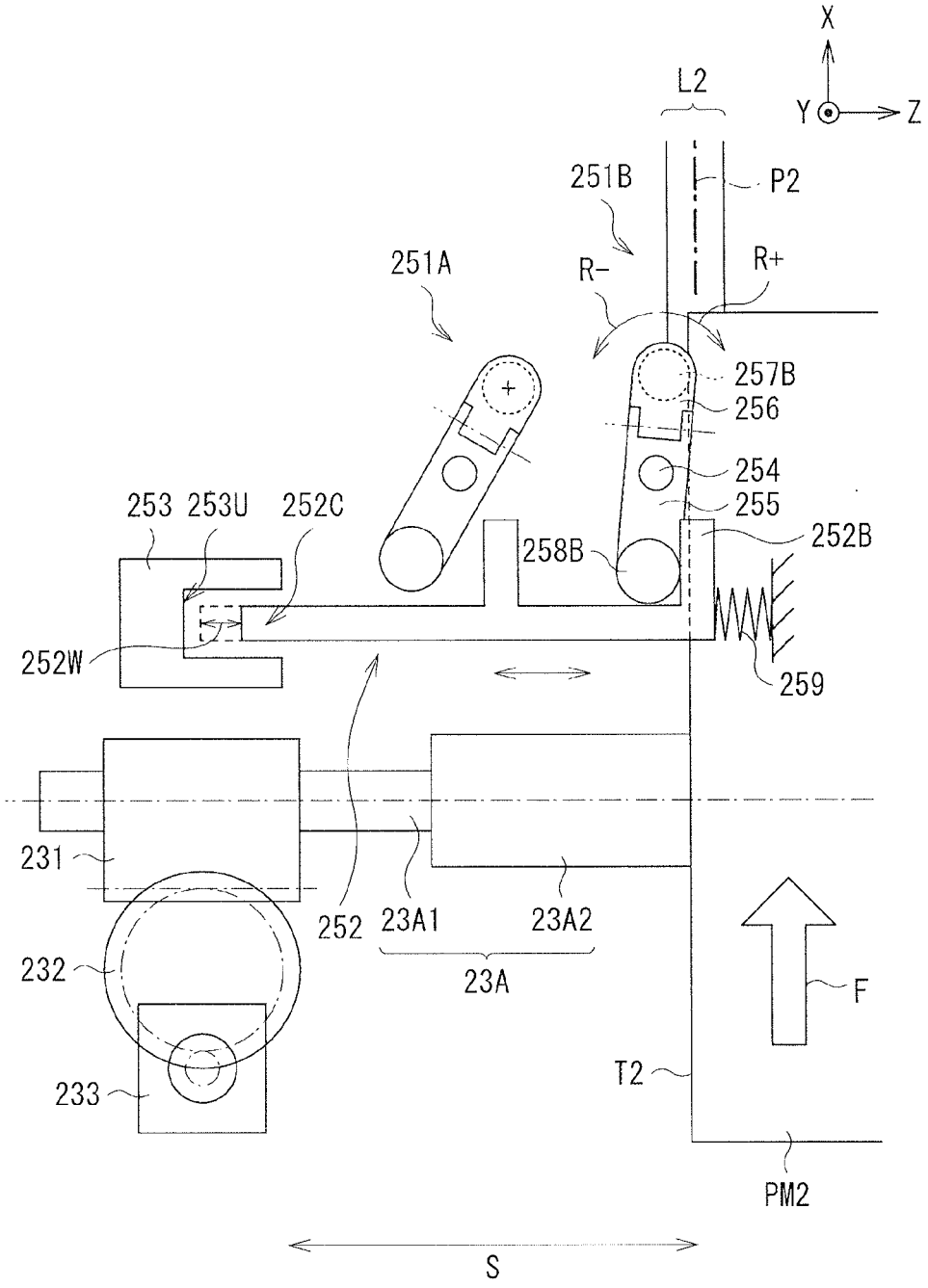
FIG. 4 is an enlarged view of the essential part and describes a correcting operation performed in a conveying section of the image forming apparatus illustrated in FIG. 1.

First, a description is given, with reference to FIG. 4, of an operation performed when the printing medium PM2 narrower in width than the printing medium PM1 is conveyed. The printing medium PM2 may be caused to travel in the conveying direction F such that the edge T2 thereof fits into the lane L2. In this case, the side face of the pin 257B in the contact section 251B comes into contact with the edge T2 of the printing medium PM2. Note that, in an initial state before the printing medium PM2 is fed, a position of the side face of the pin 257B in the contact section 251B is so adjusted as to be coincident with the reference position P2 in the scanning direction S.

Under such circumstances, when the position of the edge T2 of the printing medium PM2 is shifted toward the left side in the drawing of FIG. 4, i.e., in a minus (−) Z direction, the pin 257B is biased in the −Z direction. This causes the pivot lever 255 and the pick lever 256 to pivot anticlockwise together in a direction denoted by an arrow R− around the shaft section 254 within an XZ plane. This in turn causes the pin 258B to bias the engagement section 252B in the −Z direction. Hence, the slider 252 is shifted toward the right side in the drawing of FIG. 4, i.e., in a plus (+) Z direction. When the position of the edge T2 of the printing medium PM2 is shifted toward the right side in the drawing of FIG. 4, i.e., in the +Z direction, the pin 257B is biased in the +Z direction. This causes the pivot lever 255 and the pick lever 256 to pivot clockwise together in a direction denoted by an arrow R+ around the shaft section 254 within the XZ plane. This in turn causes the engagement section 252B in contact with the pin 258B to be biased in the −Z direction by the elastic member 259. Hence, the slider 252 is shifted toward the left side in the drawing of FIG. 4, i.e., in the −Z direction.

In both of the cases in which the position of the edge T2 is shifted in the −Z direction and in the +Z direction, the amount of displacement 252W of the first end 252C in the slider 252 from an initial position is detected by the displacement sensor 253, and the detection signal is sent to the control section 80. The control section 80 may determine, based on data on the amount of displacement 252W derived from the displacement sensor 253, the difference in the scanning direction S between the edge T2 and the reference position P2, and so correct the traveling position of the printing medium PM2 that the amount of displacement of the edge T2 is brought closer to zero at a predetermined speed. To correct the traveling position, the control section 80 may drive the roller shift motor 233 to rotate the rack gear 231 through the rack pinion gear 232, to thereby shift the conveying drive roller 23A in the +Z direction or in the −Z direction.

Figure 5:
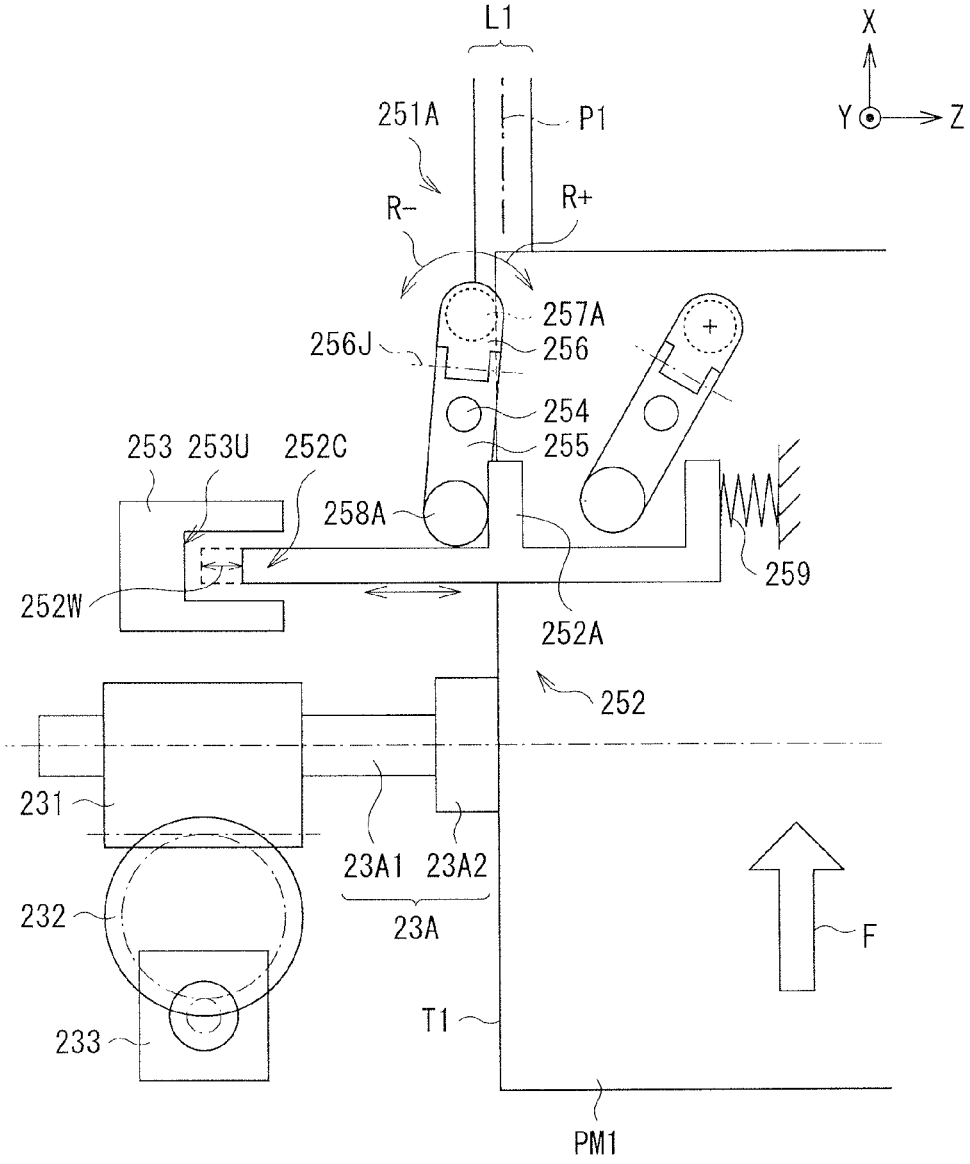
FIG. 5 is another enlarged view of the essential part and describes the correcting operation performed in the conveying section of the image forming apparatus illustrated in FIG. 1.

Next, a description is given, with reference to FIG. 5, of an operation performed when the printing medium PM1 wider in width than the printing medium PM2 is conveyed. The printing medium PM1 may be caused to travel in the conveying direction F such that the edge T1 thereof fits into the lane L1. In this case, the edge T1 of the printing medium PM1 comes into contact with the side face of the pin 257A in the contact section 251A. Note that, in an initial state before the printing medium PM1 is fed, a position of the side face of the pin 257A in the contact section 251A is so adjusted as to be coincident with the reference position P1.

In both of the cases in which the position of the edge T1 is shifted in the −Z direction and in the +Z direction, a process is performed similar to that of the case in which the printing medium PM2 is conveyed. More specifically, the control section 80 may determine, based on the data on the amount of displacement 252W derived from the displacement sensor 253, the difference in the scanning direction S between the edge T1 and the reference position P1, and so correct the traveling position of the printing medium PM1 that the amount of displacement of the edge T1 is brought closer to zero at a predetermined speed.

Figure 6:
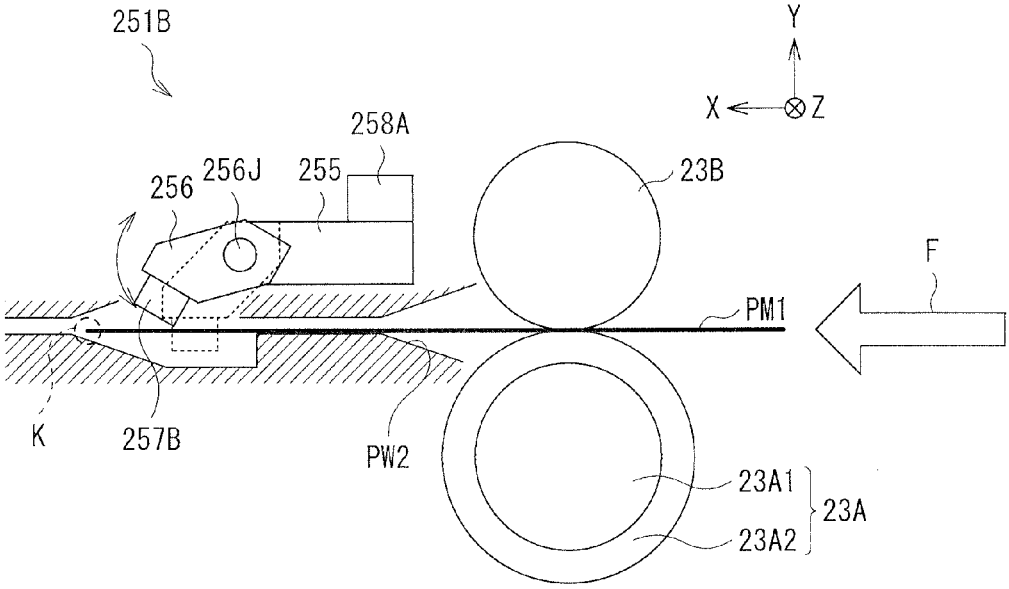
FIG. 6 is an enlarged view of the essential part and describes an operation of contact sections in the conveying section of the image forming apparatus illustrated in FIG. 1.

A region through which the printing medium PM1 passes is overlapped with the lane L2 when the printing medium PM1 travels in the conveying direction F in such a manner that the edge T1 fits into the lane L1. Hence, as illustrated in FIG. 6, when the printing medium PM1 passes through the pair of conveying rollers 23 to advance to a region near the contact section 251B, the edge K in the conveying direction F of the printing medium PM1 as a front edge comes into contact with the side face of the pin 257B, following which the printing medium PM1 so advances that the edge K then pushes out, in the traveling direction (i.e., in a +X direction), the side face of the pin 257B. The pin 257B pushed out by the edge K of the printing medium PM1 pivots around the pivot axis 256J together with the pick lever 256, and is thus pushed up on the upper side (i.e., in the +Y direction). As a result, the pin 257B slides over the top surface of the printing medium PM1 passing therethrough, preventing the pin 257B from serving as a hindrance to the traveling of the printing medium PM1.

Figure 7A:
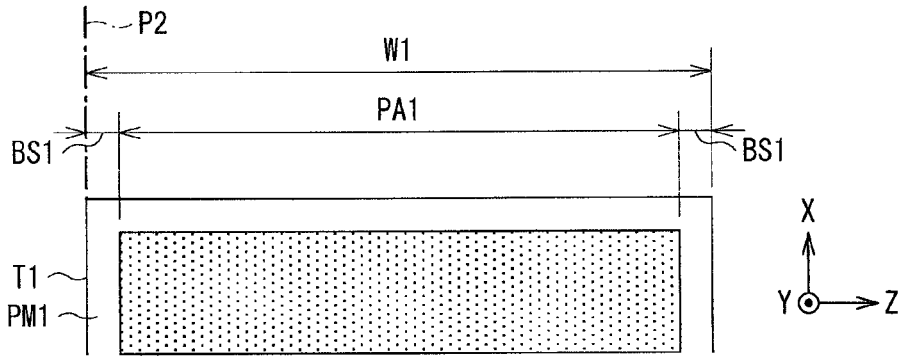
FIG. 7A is a first explanatory view for describing an action and an effect of the image forming apparatus illustrated in FIG. 1.
Figure 7B:
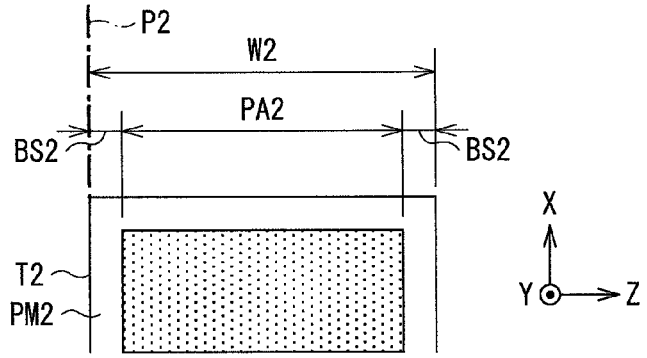
FIG. 7B is a second explanatory view for describing an action and an effect of the image forming apparatus illustrated in FIG. 1.

Incidentally, various preprocessing and post-processing units may be coupled to an image forming apparatus directed to on-demand printing for which prompt processing is required according to needs. Some examples of the preprocessing unit may include particular feeders such as an envelope feeder that feeds an envelope as a printing medium and a roll feeder that feeds long continuous paper. Some examples of the post-processing unit may include a discharging belt conveyer that may convey a printed envelope, a rewinder that rewinds the printed continuous paper, and a cutter that may cut out, from such continuous paper, printed labels provided on the continuous paper. In general, the image forming apparatus to which the preprocessing unit, the post-processing unit, or both is coupled often causes a printing medium to travel with an edge in a width direction of the printing medium being defined as the reference. In this case, it is preferable, in terms of work efficiency, that the edges of the respective printing media be allowed to fit in with the same reference equally irrespective of widths of the respective printing media, as illustrated by way of example in FIGS. 7A and 7B. FIG. 7A illustrates an example case in which printing is to be so performed, on the printing medium PM1 having a relatively wider width W1 in a region having a width PA1, as to leave a margin having a width BS1 at both ends of the printing medium PM1. FIG. 7B illustrates an example case in which printing is to be so performed, on the printing medium PM2 having a relatively narrower width W2 (<W1) in a region having a width PA2, as to leave a margin having a width BS2 (≈BS1) at both ends of the printing medium PM2. In either case, it is desirable that the printing media PM1 and PM2 travel in such a manner that the edges T1 and T2 of the respective printing media PM1 and PM2 are coincident with the reference position P2.

Figure 7C:
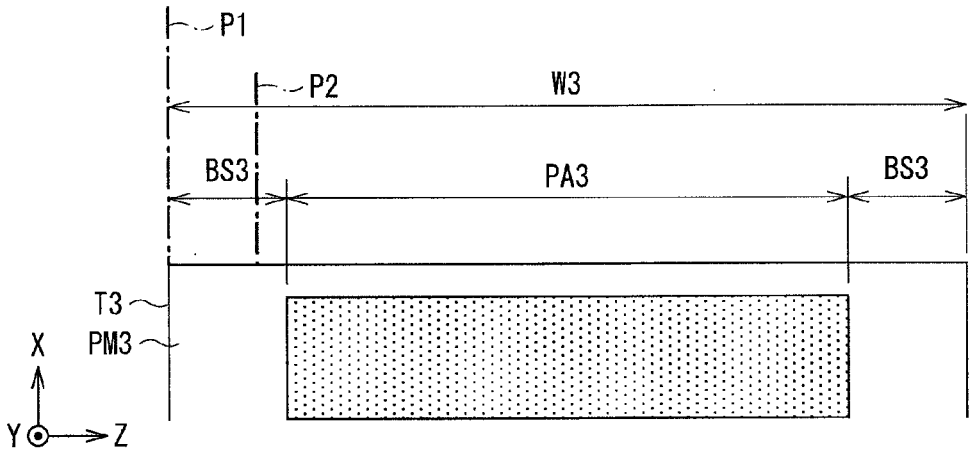
FIG. 7C is a third explanatory view for describing an action and an effect of the image forming apparatus illustrated in FIG. 1.

However, when printing is to be performed on a printing medium PM3 having a larger width W3 (>W1) as illustrated in FIG. 7C, it is necessary to cause the printing medium PM3 to travel in such a manner that an edge T3 of the printing medium PM3 is coincident with the reference position P1 located on the outer side of the reference position P2.

Under such circumstances, if an operator of the image forming apparatus is required to select the different reference positions manually in accordance with sizes of the printing media, there is a possibility of a decrease in work efficiency or an erroneous selection of sizes of the printing media PM.

In contrast, the image forming apparatus 1 according to the present example embodiment makes it possible to select the different reference positions automatically in accordance with sizes of the printing media PM. Hence, it is possible to prevent the decrease in work efficiency or the erroneous operation upon the selection of the conditions resulting from the selection of the reference positions in accordance with the types of the printing media. Also, it is possible to detect the positions of the edges T1 and T2 in the scanning direction S of the respective conveyed printing media PM1 and PM2 accurately yet easily, and to correct the shifts in position of the respective edges T1 and T2 thereof appropriately and promptly. In particular, the contact section 251A and the contact section 251B may be displaceable independently from each other in the scanning direction S, and the amount of displacement of the contact section 251A and that of the contact section 251B may be transmitted independently from each other to the displacement sensor 253, making it possible to detect the positions of the edges T1 and T2 at a higher degree of accuracy. Hence, the image forming apparatus 1 makes it possible to improve an accuracy of a position at which an image is formed on each of the printing media PM1 and PM2.

Other Modification Examples

Although the invention has been described in the foregoing by way of example with reference to the example embodiment and the modification examples, the invention is not limited thereto but may be modified in a wide variety of ways.

For example, in the example embodiment and the modification examples, two medium feeding trays 11 and 61 are provided to feed the printing media PM1 and PM2 of two sizes to the conveying section 20. In an alternative embodiment, three or more medium feeding trays may be provided.

Also, a description has been given of the example embodiment and the modification examples in which the exemplary image forming apparatus is of the secondary transfer system and uses the image forming units corresponding to four colors. The invention is however not limited to that disclosed in the example embodiment and the modification examples. The image forming apparatus may use image forming units corresponding to three or less colors, or corresponding to five or more colors. The image forming apparatus may also be of a primary transfer system in which transfer is performed directly from the image forming section onto the printing medium.

A series of processes described in the example embodiment and the modification examples may be performed based on a hardware (such as a circuit) or on a software (such as a program). In an embodiment where the processes are implemented based on the software, the software may contain a group of programs that causes a computer or a machine to execute each function. The programs may be incorporated in the computer or the machine in advance, or may be installed from any network or a storage medium.

The LED head including the light-emitting diodes as a light source is used in the example embodiment and the modification examples. In an alternative embodiment, any other light emitting device such as, but not limited to, a laser device may be used for the light source.

Also, a description has been given of the example embodiment and the modification examples in which the image forming apparatus having a printing function corresponds to a concrete but non-limiting example of the "image forming apparatus" in one embodiment of the invention. However, the term "image forming apparatus" is not limited to the image forming apparatus having a printing function. Any of the example embodiment and the modification examples described above is applicable to an image forming apparatus that may function as a multi-function peripheral. The multi-function peripheral may include a scanner function, a facsimile function, or both, in addition to the printing function as described above.

Furthermore, the invention encompasses any possible combination of some or all of the various embodiments and the modification examples described herein and incorporated herein.

It is possible to achieve at least the following configurations from the above-described example embodiments of the invention.

(1) A printing medium conveying unit, including:

a first contact section;

a second contact section disposed adjacent to the first contact section in a first direction;

a printing medium conveying section configured to convey a printing medium in a second direction that is substantially orthogonal to the first direction, the printing medium conveying section allowing a first edge in the first direction of the printing medium to come into contact with one of the first contact section and the second contact section to displace one of the first contact section and the second contact section in the first direction; and a position detecting section configured to detect a position in the first direction of the first edge, based on an amount of the displacement of one of the first contact section and the second contact section that has come into contact with the first edge.

(2) The printing medium conveying unit according to (1), wherein the second contact section is retracted from a front edge in the second direction of the printing medium upon the contact of the first edge with the first contact section, and is displaced in the first direction in accordance with the position of the first edge upon the contact of the first edge with the second contact section.

(3) The printing medium conveying unit according to (1) or (2), wherein the printing medium conveying section includes a first lane and a second lane that are provided side-by-side in the first direction, and conveys the printing medium in the second direction to cause the first edge to fit into one of the first lane and the second lane, the first contact section is provided corresponding to the first lane, and the second contact section is provided corresponding to the second lane.

(4) The printing medium conveying unit according to any one of (1) to (3), wherein the first contact section and the second contact section are displaced independently from each other in the first direction.

(5) The printing medium conveying unit according to any one of (1) to (4), wherein the amount of the displacement in the first direction of the first contact section and the amount of the displacement in the first direction of the second contact section are transmitted independently from each other to the position detecting section.

(6) The printing medium conveying unit according to any one of (1) to (5), wherein the second contact section includes:

a first member displaceable in the first direction; and a second member displaceable in a third direction that is substantially orthogonal to both the first direction and the second direction.

(7) The printing medium conveying unit according to any one of (1) to (5), wherein the second contact section includes:

a first member configured to pivot around a first pivot axis that is substantially orthogonal to both the first direction and the second direction; and a second member provided at a first end of the first member and configured to pivot around a second pivot axis that is substantially orthogonal to the first pivot axis, and including a first protrusion protruded along the first pivot axis, and wherein the first protrusion:

comes into contact with the first edge of the printing medium upon non-contact of the first edge of the printing medium with the first contact section; and is retracted from a front edge in the second direction of the printing medium upon the contact of the first edge with the first contact section, the first protrusion being retracted from the front edge by the pivot of the second member around the second pivot axis, and the second member pivoting as a result of biasing of the second member in the second direction by a second edge in the second direction of the printing medium.

(8) The printing medium conveying unit according to (7), wherein the position detecting section includes a slider, the slider having an engagement section and being configured to move in the first direction, and the first member of the second contact section includes a second end provided with a second protrusion, the second protrusion being configured to come into engagement with the engagement section.

(9) The printing medium conveying unit according to any one of (1) to (8), wherein the printing medium conveying section includes a conveying roller having a shaft section that extends in the first direction, and the first contact section and the second contact section are located downstream of the printing medium conveying section.

(10) The printing medium conveying unit according to (9), wherein the printing medium conveying section includes a moving mechanism configured to move the conveying roller in the first direction.

(11) The printing medium conveying unit according to any one of (1) to (10), wherein the position detecting section detects one of a difference in the first direction between the first edge and a first reference position and a difference in the first direction between the first edge and a second reference position, the first reference position being included in the first lane, and the second reference position being included in the second lane.

(12) An image forming apparatus, including:

a first contact section;

a second contact section disposed adjacent to the first contact section in a first direction;

a printing medium conveying section configured to convey a printing medium in a second direction that is substantially orthogonal to the first direction, the printing medium conveying section allowing a first edge in the first direction of the printing medium to come into contact with one of the first contact section and the second contact section to displace one of the first contact section and the second contact section in the first direction;

a position detecting section configured to detect a position in the first direction of the first edge, based on an amount of the displacement of one of the first contact section and the second contact section that has come into contact with the first edge; and an image forming section configured to form an image on the printing medium conveyed by the printing medium conveying section.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A printing medium conveying unit, comprising:

a first contact section;

a second contact section disposed adjacent to the first contact section in a first direction;

a printing medium conveying section configured to convey a printing medium in a second direction that is substantially orthogonal to the first direction, the printing medium conveying section allowing a first edge in the first direction of the printing medium to come into contact with one of the first contact section and the second contact section to displace one of the first contact section and the second contact section in the first direction; and a position detecting section configured to detect a position in the first direction of the first edge, based on an amount of the displacement of one of the first contact section and the second contact section that has come into contact with the first edge.

2. The printing medium conveying unit according to claim 1, wherein the second contact section is retracted from a front edge in the second direction of the printing medium upon the contact of the first edge with the first contact section, and is displaced in the first direction in accordance with the position of the first edge upon the contact of the first edge with the second contact section.

3. The printing medium conveying unit according to claim 1, wherein the printing medium conveying section includes a first lane and a second lane that are provided side-by-side in the first direction, and conveys the printing medium in the second direction to cause the first edge to fit into one of the first lane and the second lane, the first contact section is provided corresponding to the first lane, and the second contact section is provided corresponding to the second lane.

4. The printing medium conveying unit according to claim 1, wherein the first contact section and the second contact section are displaced independently from each other in the first direction.

5. The printing medium conveying unit according to claim 1, wherein the amount of the displacement in the first direction of the first contact section and the amount of the displacement in the first direction of the second contact section are transmitted independently from each other to the position detecting section.

6. The printing medium conveying unit according to claim 1, wherein the second contact section includes:

a first member displaceable in the first direction; and a second member displaceable in a third direction that is substantially orthogonal to both the first direction and the second direction.

7. The printing medium conveying unit according to claim 1, wherein the second contact section includes:

a first member configured to pivot around a first pivot axis that is substantially orthogonal to both the first direction and the second direction; and a second member provided at a first end of the first member and configured to pivot around a second pivot axis that is substantially orthogonal to the first pivot axis, and including a first protrusion protruded along the first pivot axis, and wherein the first protrusion:

comes into contact with the first edge of the printing medium upon non-contact of the first edge of the printing medium with the first contact section; and is retracted from a front edge in the second direction of the printing medium upon the contact of the first edge with the first contact section, the first protrusion being retracted from the front edge by the pivot of the second member around the second pivot axis, and the second member pivoting as a result of biasing of the second member in the second direction by a second edge in the second direction of the printing medium.

8. The printing medium conveying unit according to claim 7, wherein the position detecting section includes a slider, the slider having an engagement section and being configured to move in the first direction, and the first member of the second contact section includes a second end provided with a second protrusion, the second protrusion being configured to come into engagement with the engagement section.

9. The printing medium conveying unit according to claim 1, wherein the printing medium conveying section includes a conveying roller having a shaft section that extends in the first direction, and the first contact section and the second contact section are located downstream of the printing medium conveying section.

10. The printing medium conveying unit according to claim 9, wherein the printing medium conveying section includes a moving mechanism configured to move the conveying roller in the first direction.

11. The printing medium conveying unit according to claim 3, wherein the position detecting section detects one of a difference in the first direction between the first edge and a first reference position and a difference in the first direction between the first edge and a second reference position, the first reference position being included in the first lane, and the second reference position being included in the second lane.

12. An image forming apparatus, comprising:

a first contact section;

a second contact section disposed adjacent to the first contact section in a first direction;

a printing medium conveying section configured to convey a printing medium in a second direction that is substantially orthogonal to the first direction, the printing medium conveying section allowing a first edge in the first direction of the printing medium to come into contact with one of the first contact section and the second contact section to displace one of the first contact section and the second contact section in the first direction;

a position detecting section configured to detect a position in the first direction of the first edge, based on an amount of the displacement of one of the first contact section and the second contact section that has come into contact with the first edge; and an image forming section configured to form an image on the printing medium conveyed by the printing medium conveying section.

* * * * *